United States Patent [19]

Gronwick et al.

[11] Patent Number: 4,594,801

[45] Date of Patent: Jun. 17, 1986

[54] TRAVEL IRON WITH PIVOTABLE HANDLE

[75] Inventors: Jerry P. Gronwick, Park Ridge; Robert J. Augustine, Downers Grove, both of Ill.

[73] Assignee: John Zink Company, Tulsa, Okla.

[21] Appl. No.: 693,912

[22] Filed: Jan. 23, 1985

[51] Int. Cl.[4] ..... D06F 75/26; D06F 75/34

[52] U.S. Cl. ..... 38/90; D32/72; 219/250; 219/255; 16/126; 38/77.5

[58] Field of Search ..... 190/115, 117; 294/137, 294/167, 169; D32/68, 69, 70, 71, 72; 219/488, 249, 250, 255; 38/77.4, 90, 92, 77.5; 220/94 R; 16/112, 126

[56] References Cited

U.S. PATENT DOCUMENTS

| | | | |
|---|---|---|---|
| 2,215,959 | 9/1940 | Gough | 38/90 |
| 2,970,394 | 2/1961 | Brumbaugh | 219/255 X |
| 3,095,493 | 6/1963 | Downing | 219/250 |
| 3,229,392 | 1/1966 | Camilleri | 38/90 |
| 3,766,673 | 10/1973 | Harroff | 219/250 X |

FOREIGN PATENT DOCUMENTS

| | | | |
|---|---|---|---|
| 964737 | 8/1950 | France | 219/250 |

*Primary Examiner*—Werner H. Schroeder
*Assistant Examiner*—Andrew M. Falik
*Attorney, Agent, or Firm*—Neil M. Rose; Clifford A. Dean

[57] ABSTRACT

A travel iron having a handle which pivots sideways between an upright "use" position and a flat "storage" position wherein the handle is pivotally mounted on the main body portion of the iron at its rear end only and wherein cam ramp and pin means provide longitudinal forward and rearward movement of the handle during its pivotal movement whereby to stabilize both ends of the handle when the handle is in its upright "use" position. A pump actuator mounted in the main body portion of the iron is actuated by a plunger slidably mounted in the handle. A dual-voltage sole plate heating circuit has a pair of identical heating elements connected in series in one voltage position of a dual-voltage switch and in parallel in the other voltage position with the output wattage being the same in both voltage positions of the switch.

23 Claims, 10 Drawing Figures

Fig. 4
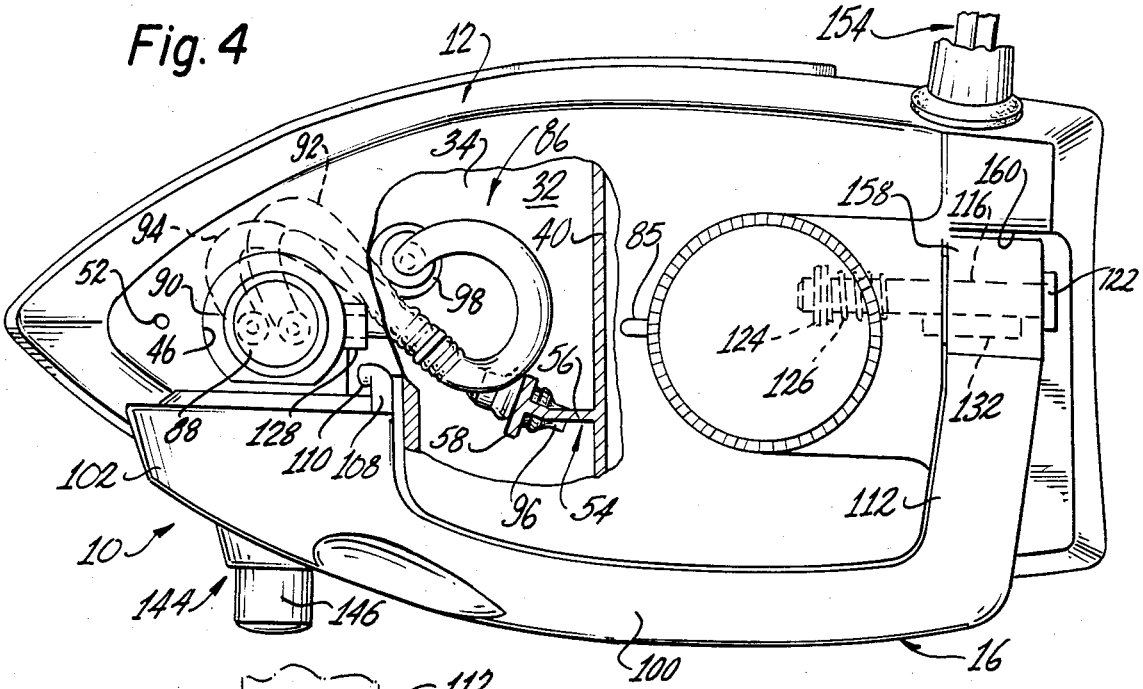
Fig. 5
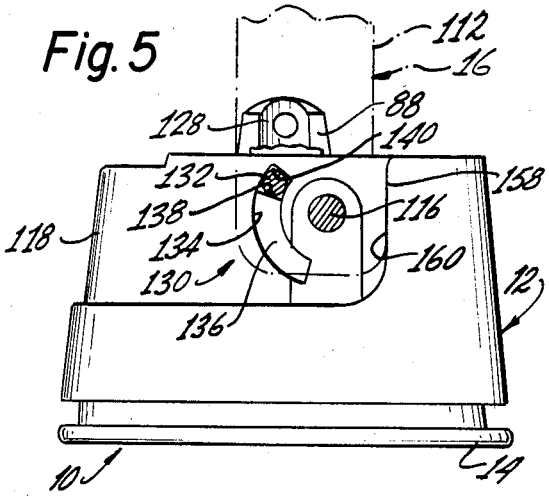
Fig. 6
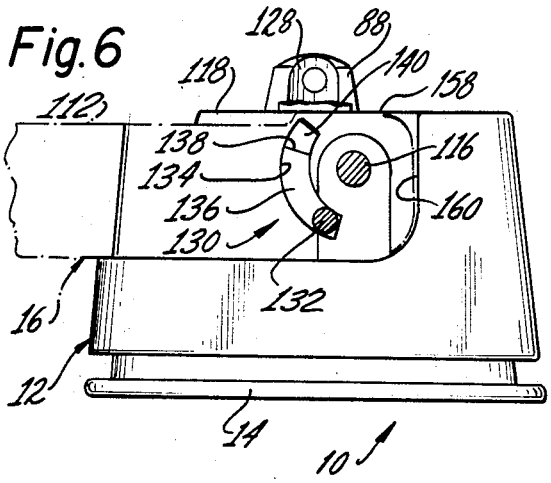
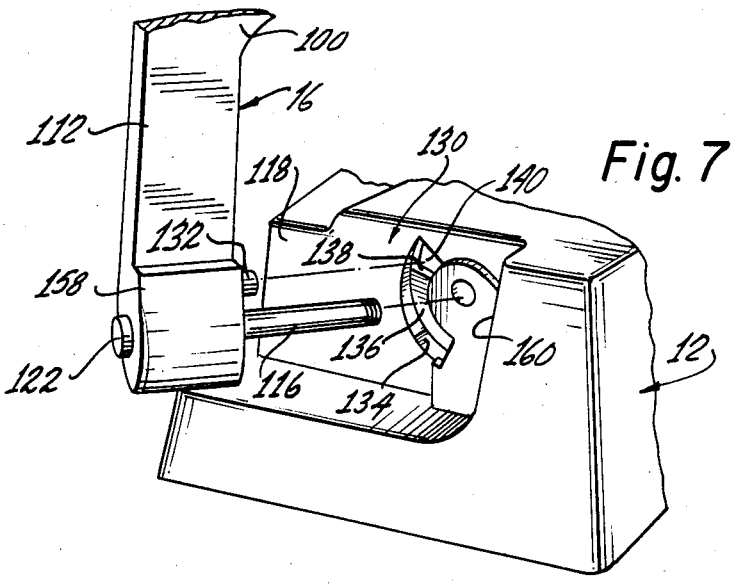
Fig. 7

TRAVEL IRON WITH PIVOTABLE HANDLE

BACKGROUND OF THE INVENTION

This invention relates to a new and improved dual-voltage travel iron having an instant steam feature. Some travel irons currently being marketed, such as the iron shown in U.S. Pat. No. De. D-275,042, have handles that are removable from the main housing which makes it possible for the two parts to become separated with one or both parts becoming lost. Other travel irons known in the art are provided with fold-down handles which make the iron more compact for packing and travel. However, no known fold-down-handle travel irons have an instant steam capability, a structural arrangement which also permits operation of same in a vertical orientation whereby the travel iron may also serve as a hanging-garment steamer, and a dual-voltage circuit wherein the wattage output is the same in both voltage modes.

BRIEF SUMMARY OF THE INVENTION

The invention is directed to a dual-voltage travel iron having an always-connected fold-down handle and a pump actuating plunger in the forward portion of the handle adapted, when actuated, to provide instant steam. The handle is pivotally mounted on the main housing portion of the iron only at its rear end where a cam arrangement is provided to move the handle a limited distance longitudinally of the main housing when it is pivotally moved between its upright "use" and flat "storage" positions to facilitate engagement and disengagement of stabilizing means between the forward end of the handle and the main housing. Two equal-value heating elements are provided which are connected in parallel in one voltage mode and in series in the other voltage mode whereby the wattage output is the same in either voltage mode.

It is an object of the present invention to provide a new and improved travel iron.

It is another object of the present invention to provide a travel iron having a fold-down handle and pump actuating means in the handle for providing instant steam when the handle is in its upright "use" position.

It is a further object of the present invention to provide a travel iron having a fold-down handle wherein the handle has limited longitudinal movement relative to the main housing when it is pivotally moved between its upright "use" position and its flat "storage" position.

It is a still further object of the present invention to provide a dual-voltage iron having a pair of identical, equal-value heating elements in a circuit whereby in either voltage setting of the dual-voltage switch the wattage output is the same.

Further objects and advantages will become apparent as the following description proceeds and the features of novelty which characterize the invention will be pointed out in the claims annexed to and forming a part of the specification.

BRIEF DESCRIPTION OF THE DRAWINGS

FIG. 4 is a top plan view, partially broken away, of the travel iron as shown in FIG. 2;

FIG. 5 is a rear elevational view of the travel iron taken generally along the line 5—5 of FIG. 3 with a portion of the handle, when in its upright "use" position, shown in broken lines;

FIG. 6 is a rear elevational view similar to FIG. 5 but with the same portion of the handle being shown in broken line in its flat "storage" position;

FIG. 7 is a partial perspective exploded view looking toward the rear of the travel iron illustrating both the assembly of the pivotally mounted handle to the main body portion of the travel iron and the associated camming arrangement;

DESCRIPTION OF THE PREFERRED EMBODIMENT

Figure 1:
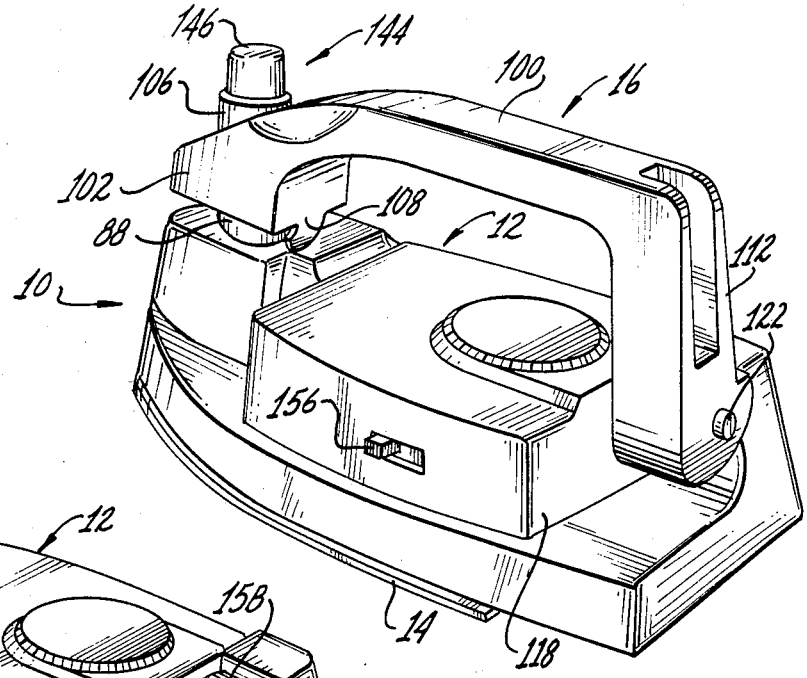
FIG. 1 is a perspective view from the rear of a travel iron embodying the invention with the handle in its upright "use" position.
Figure 2:
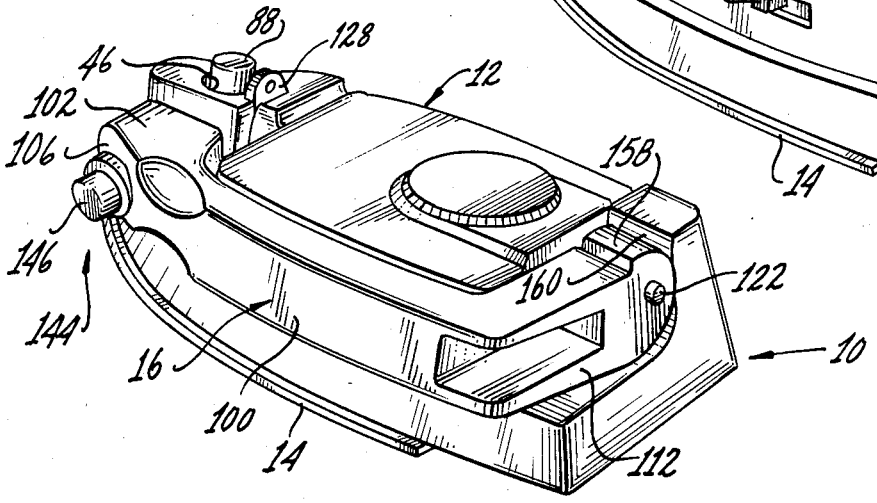
FIG. 2 is a perspective view similar to FIG. 1 but with the handle in its flat "storage" position.
Figure 3:
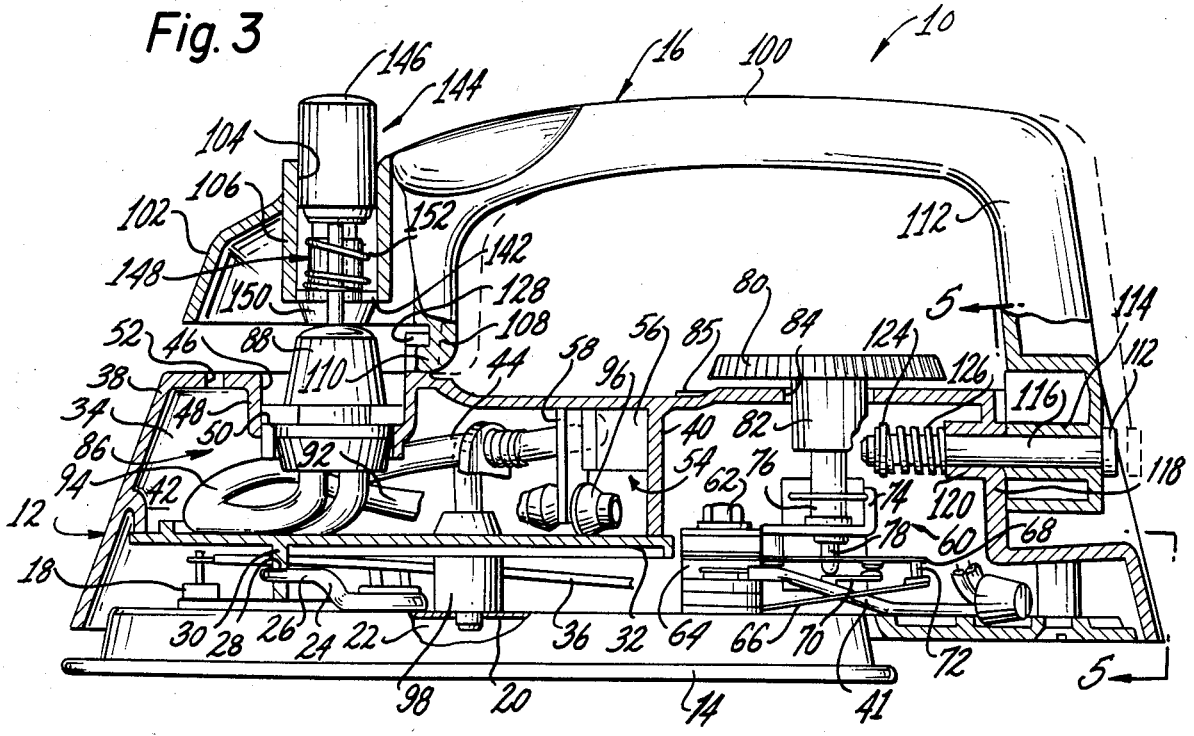
FIG. 3 is an enlarged partial vertical and longitudinal sectional view of the travel iron as shown in FIG. 1 with the rearwardmost position of the handle being indicated by broken lines.
Figure 8:
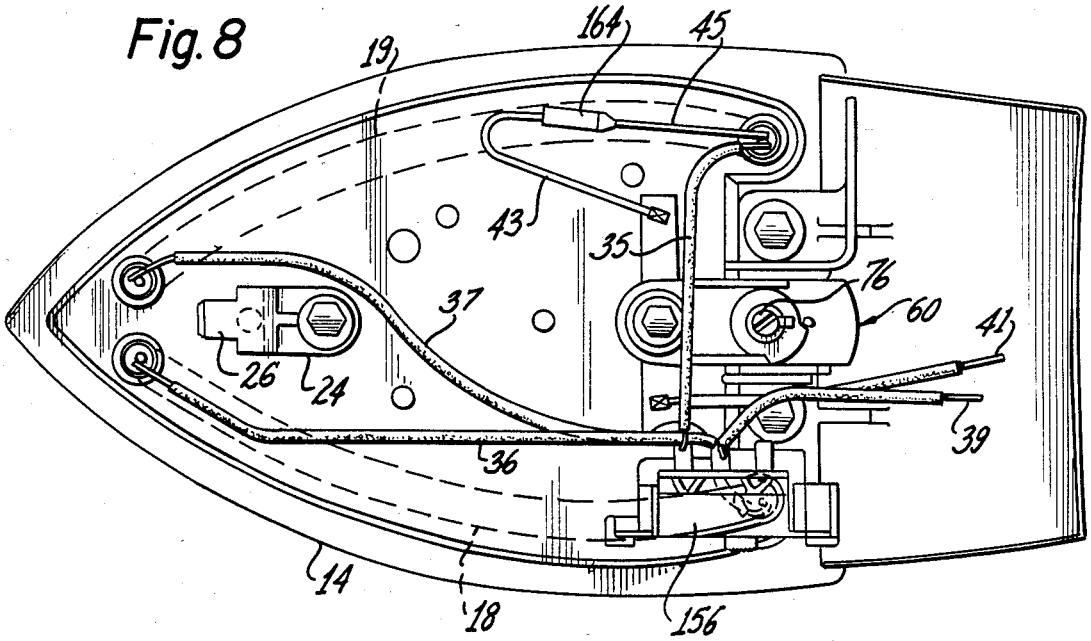
FIG. 8 is a top plan view of the sole plate with the housing removed.
Figure 9:
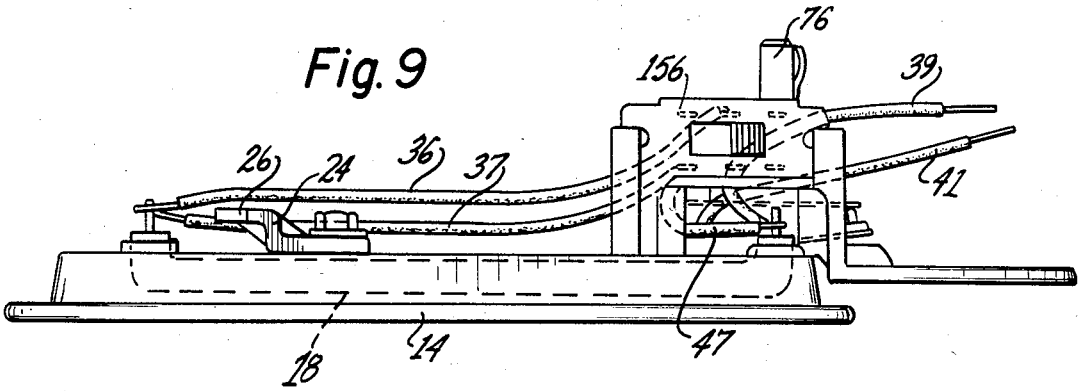
FIG. 9 is a side elevational view thereof.

Referring to the drawings, there is shown in FIGS. 1 and 2 a preferred embodiment of a travel iron 10 having a main body portion or housing 12, including a known-type ported sole plate 14, and a pivotally mounted fold-down handle 16, the handle 16 being shown in its upright "use" position in FIG. 1 and in its flat "storage" position in FIG. 2. The main body portion 12 and the handle 16 are formed of suitable light-weight, heat resistant plastics. The ported sole plate 14, which is characterized by a pair of identical, equal-value heating elements 18 and 19 disposed one each along opposite sides of said sole plate 24 as best illustrated in FIG. 8, a cover plate 20, and a steam boiler area 22, is secure the main body portion 12 in a manner known in the art which includes a Z-shaped hold-down positioning bracket 24 secured to the cover plate 20 and having a forwardly projecting neck portion 26 which is received in a slot 28 formed in a rib 30 which depends from a wall 32 defining the bottom of a reservoir 34 in the main body portion 12. The reservoir 34 is further defined by a front wall 38, a rear wall 40, side walls 42, and a top wall 44, all of which are integral portions of the main body portion 12. The top wall 44 is characterized by a generally circular filling opening or filler port 46 defined by a depending integrally formed annular wall portion or sleeve 48 having an upwardly facing shoulder 50, the reason for which will be discussed hereinafter, and by a small vent port 52 located forwardly of the filler port 46. As best shown in FIGS. 3 and 4, a positioning member 54 is provided at the rear of the reservoir 34 for a purpose that will be explained hereinafter. The positioning member 54 is characterized by a forwardly extending vertical wall portion 56 formed integrally with the rear of the top wall 44 and the upper portion of the rear wall 40 and by a depending wall portion 58 which depends from the top wall 44 and the forward edge of the wall portion 56 toward the bottom wall 32. Although not clearly shown in the drawings, the bottom edge of the depending wall portion 58 is notched for a reason to be explained hereinafter.

In order to accurately control the temperature of the soleplate 14, there is provided a known-type thermostatic switch 60 which is mounted on the soleplate 14 by means of a fastener 62. The thermostatic switch 60 is a conventional stacked thermostat 64 having a bimetallic member 66 supported thereby in good heat transfer relation to the soleplate 14. A pair of contact-carrying leaves 68 and 70 are supported in vertically spaced relationship by the stacked thermostat 64 with the upper leaf 68 being engageable by a ceramic actuator 72 carried on the end of the bimetallic member 66 when the soleplate temperature rises above a preset temperature whereby to disengage the normally engaged contact-carrying leaves 68 and 70 and interrupt power to the heating element and thus decrease the soleplate temperature.

A frame member 74 is supported by the stacked thermostat 64 above the contact-carrying leaves 68 and 70 and has a temperature adjusting member 76 threadedly mounted therein with a depending ceramic finger 78 adapted for raising and lowering engagement with the lower contact-carrying leaf 70 whereby to permit regulating the temperature at which the bimetallic member 66 opens the switch contacts. The temperature adjusting member 76 is rotatable by a knob 80 positioned above the top wall 44 of the main housing portion 12 and having a sleeve portion 82 which extends downwardly through an opening 84 provided in the top wall 44 for telescopic driving engagement with the temperature adjusting member 76. A fixed marker 85 for suitable temperature indicia which may be provided on the top of the knob 80 is provided on the top wall 44 adjacent the periphery of the knob 80.

It is noted that the thermostatic switch structure 60 is located within the main body portion 12 rearwardly of the rear wall 40 of the reservoir 34.

In order to provide instant steam from the ported soleplate 14 when the travel iron 10 is oriented either horizontally for manual ironing or vertically for steaming hanging garments, a known-type pump 86 is provided. As best illustrated in FIGS. 3 and 4, the pump 86 is characterized by a collapsible pump actuator 88 which is removably mounted in the filling opening 46 with an annular flange portion 90 thereof being supported on the shoulder 50. Depending from the actuator 88 are inlet and outlet tubes 92 and 94, respectively. The other end 96 of the inlet tube 92 is retained in the lower rear portion of the reservoir 34 by the notched bottom edge of the depending wall portion 58 of the positioning member 54. This arrangement insures the provision of instant steam upon operation of the pump 86 with the travel iron 10 in either its horizontal ironing orientation or its vertical garment-steaming orientation. The other end of the outlet tube 94 is connected to a known-type orificed fitting 98 mounted in and disposed between the bottom wall 32 of the reservoir 32 and the cover plate 20 of the sole plate 14 for directing a charge of water into the steam chamber 22 where, upon contact with the heated walls thereof, it is flashed into steam for discharge from the ported sole plate as instant steam, either during normal ironing operations or garment steaming operations. The pump 86 is adapted to be actuated only when the handle 16 is in its upright "use" position in a manner which will be described hereinafter.

As illustrated in FIGS. 1 and 2, the handle 16 is pivotally mounted, at its rear end only, on the main body portion 12 of the travel iron 10 for movement between an upright "use" position as shown in FIG. 1 and a flat "storage" position as shown in FIG. 2, the main body portion 12 being shaped to complementarily receive the handle 16 in its flat "storage" position whereby to provide a compact unit for ease of storage and/or packing in luggage.

The handle 16 is characterized by a longitudinally extending gripping portion 100, by an integral front-end portion 102 having a bore 104 defined by a sleeve portion 106 and a depending flange member 108 having a forwardly extending stabilizing pin formation 110 provided thereon for purposes to be discussed hereinafter, and by an integral rear leg portion 112 which extends generally normally from the rear end of the gripping portion 100 and has a sleeve portion 114 for pivotally mounting the rear of the handle 16 on a pivot pin 116 which is adapted to project rearwardly from a rear wall portion 118 of the main body portion 12 of the iron 10. The pivot pin 116 is mounted in a longitudinally disposed sleeve configuration 120 associated with the rear wall portion 118, as is best shown in FIGS. 3, 4 and 7. A head 122 of the pin 116 is disposed against the rear surface of the rear leg portion 112 of the handle 16 and a retaining ring 124 is secured on the forward end of the pin 116. A coil spring 126 is disposed about the pivot pin 116 and is seated between the retaining ring 124 and the forward end of the sleeve configuration 120 whereby to normally bias the pivot pin 116 and the handle 16 forwardly into the full line position shown in FIG. 3. In this longitudinally forward position of the handle 16, the pin formation 110 is received in a bored upright ear 128 (FIGS. 2, 3, 5 and 6) integrally formed on the top wall 44 of the main body portion 12 just rearwardly of the filler port 46 whereby to aid in further stabilization of the handle 16 when it is in its upright "use" position. To pivot the handle 16 downwardly into its flat "storage" position, the handle 16 must first be manually moved longitudinally rearwardly relative to the main body portion 12 to the broken line position shown in FIG. 3 so as to disengage the pin formation 110 on the front of the handle 16 from the bored upright ear 128.

As is best shown in FIGS. 5, 6 and 7, a cam and pin arrangement 130 is provided at the rear end of the handle 16 to provide automatic rearward movement of the handle 16 when it is pivoted upwardly from its flat "storage" position toward its upright "use" position whereby to not only prevent blocking engagement of the pin formation 110 against the side edge of the bored upright ear 128 but to facilitate engagement of the pin formation 110 in the bored upright ear 128 as previously described. The cam and pin arrangement 130 is characterized by a forwardly projecting cam pin 132 which is mounted in the rear leg portion 112 of the handle 16 alongside the pivot pin 116 and by an arcuate groove 134 formed in the rear wall portion 118 of the main body portion 12 in alignment with the arcuate path of movement of the cam pin 132 and having an inclined cam surface or ramp 136 which is inclined in a rearward direction from the bottom of the groove 134 at the lower end thereof to the top of the groove 134 at a point spaced from the upper end of the groove 134 a distance equal to at least the diameter of the cam pin 132, at which point a shoulder wall 138 extends forwardly to the bottom of the groove 134, thus defining a recess 140 for the cam pin 132 when the handle 16 is in its forwardmost upright "use" position and providing stabilization of the rear portion of the handle 16 when same is in its upright "use" position, as is best illustrated in FIG. 5.

When the handle is in its upright "use" position, the bore 104 formed in the front portion 102 of the handle 16 is vertically aligned with the filler port 46 and the pump actuator 88 which is removably mounted therein.

As shown in FIG. 3, the sleeve portion 106 defining the bore 104 is provided at its lower end with an inwardly directed flange 142. A plunger member 144 is slidably mounted in the bore 104 for operating engagement with the pump actuator 88 to provide instant steam as previously discussed herein. The plunger member 144 is characterized by a thumb-engageable portion 146 which normally projects above the upper surface of the handle 16 and by a resilient split stem portion 148 which extends downwardly past the inwardly directed flange 142 and has an enlarged head portion 150 with an upper surface engageable with the underside of the inwardly directed flange 142 to limit upward movement of the plunger member 144 out of the bore 104 and with a lower surface engageable with the pump actuator 88 to operate the pump 86 and thus provide instant steam as previously described. A coil spring 152 disposed over the stem portion 148 is seated between the underside of the thumb-engageable portion 146 and the upper surface of the inwardly directed flange 142 whereby to bias the plunger member 144 upwardly in the bore 104.

Figure 10:
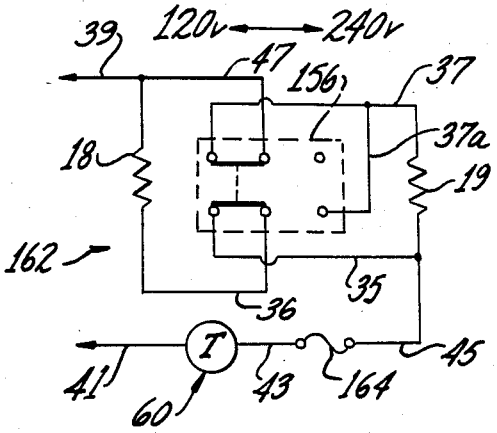
FIG. 10 is a circuit diagram of the dual-voltage power circuit.

As previously noted herein, the heating circuit 162 shown in FIG. 10 is characterized by the pair of identical equal-value heating elements 18 and 19 and a dual-voltage switch 156 interconnected such that the same output wattage is developed when the switch 156 is in its 120 volt position as when the switch 156 is in its 240 volt position. When the switch 156 is in its 120 volt position, as shown in FIG. 10, the heating circuit 162 is characterized by the two heating elements 18 and 19 being connected in parallel across two power leads 39 and 41 leading to a power cord 154 with heating element 18 being connected at one end to power lead 39 and at the other end through a lead 36, the switch 156, leads 35 and 45, a fuse 164, a lead 43, and the thermostatic switch 60 to the power lead 41 and with the heating element 19 being connected, in parallel, at one end to power lead 39 through lead 37, the switch 156 and the lead 47 and at the other end through lead 45, fuse 164, lead 43, and thermostatic switch 60 to power lead 41. When the switch 156 is in its 240 volt position, the power circuit 162 is characterized by the two heating elements 18 and 19 being connected in series across the two power leads 39 and 41. This series circuit includes power lead 39, heating element 18, lead 36, switch 156, leads 37*a* and 37, heating element 19, lead 45, fuse 164, lead 43, and thermostatic switch 60 and power lead 41.

With the resistance of the two equal-value heating elements 18 and 19 each being in the order of 41 ohms, for example, the output wattage in both the 120 volt and 240 volt positions of the dual-voltage switch 156 is 700 watts. It is thus a much simpler matter to select suitable material for the sole plate, plastic housing parts, etc. than with at least one known dual-voltage iron which utilizes a diode in the circuitry for dual-voltage operation with the output wattage varying depending upon which position the dual-voltage switch is in.

In summary, assuming the travel iron 10 has just been unpacked or taken from a storage location for either an ironing or garment-steaming operation and the handle 16 is in its flat "storage" position, the first step would be to remove the pump actuator 88 from the filler port 46 and fill the reservoir 34 with water. There is sufficient length and flexibility of the inlet and outlet tubes 92 and 94 to permit such removal of the pump actuator 88. After the pump actuator 88 has been replaced in the filler port 46, the handle 16 is pivoted upwardly toward its upright "use" position. During such upward pivoting movement, the cam pin 132 moves along the inclined cam surface or ramp 136 shifting the handle 16 longitudinally rearwardly relative to the main body portion 12 against the force of the coil spring 126 whereby the forwardly extending pin formation 110 on the handle 16 clears the bored upright ear 128 on the main body portion 12 until the handle 16 reaches its upright "use" position as determined by engagement of a surface 158 on the handle 16 with a generally vertical surface 160 on the main body portion 12, as best illustrated in FIGS. 4–7. In this upright "use" position, the cam pin 132 clears the ramp 136 whereby the coil spring 126 moves the handle 16 longitudinally forwardly to simultaneously engage the cam pin 132 in the recess 140 and the forwardly projecting pin formation 110 in the bored upright ear 128, thus stabilizing both the front and rear portions of the handle 16 when it is in its upright "use" position. After the power cord 154 has been plugged into an outlet, the dual-voltage switch 156 having been properly set, and the temperature adjusting knob 80 has been turned to the desired setting, ironing or garment-pressing may be commenced.

When instant steam is desired, the pump 86 is activated by depressing the plunger member 144 one or more times. At the completion of an ironing or garment-steaming operation the handle 16 is manually moved rearwardly in a longitudinal direction relative to the main body portion 12 against the force of the coil spring 126 whereby to simultaneously disengage the forwardly extending pin formation 110 from the bored upright ear 128 and the cam pin 132 from the recess 140 after which the handle 16 may be pivoted downwardly toward its flat "storage" position. During this downward pivoting movement, due to the action of the coil spring 126 and movement of the cam pin 132 along the inclined ramp 136, the handle 16 is again automatically moved forwardly in a longitudinal direction relative to the main body portion 12. Prior to storage or packing, the pump actuator 88, which has now been cleared by movement of the handle 16 from its upright "use" position to its flat "storage" position, should be removed from the filler port 46 and the reservoir 34 drained.

While there has been shown and described a preferred embodiment of the invention, it will be obvious to those skilled in the art that changes and modifications may be made without departing from the invention, and that it is intended by the appended claims to cover all such changes and modifications as fall within the true spirit and scope of the invention.

What we claim as new and desire to secure by Letters Patent of the United States is:

1. A pressing iron comprising a housing having a sole plate, a forwardly and rearwardly movable handle pivotally mounted at one end only on said housing for sidwise pivoting movement between an upright "use" position and a flat "storage" position, and stabilizing means provided on the other end of said handle and on said housing, said stabilizing means being operational only when said handle is in its upright "use" position.

2. A pressing iron as recited in claim 1 having a water reservoir and pump means in said housing, and plunger means in said handle for actuating said pump means only when said handle is in said upright "use" position to provide instant steam.

3. A pressing iron as recited in claim 1 having a pair of identical heating elements for said sole plate and a dial-voltage switch for connecting said heating elements in series in one voltage position of said switch and in parallel in the other position.

4. A pressing iron comprising a housing having a solt plate, a handle, a pair of identical heating elements for said sole plate disposed one each along opposite sides of said sole plate, and a dual-voltae switch for connecting said heating elements in series in one voltage position of said switch and for connecting said heating elements in parallel in the other voltage position of said switch.

5. A travel iron comprising a housing having a sole plate, a forwardly and rearwardly movable handle pivotally mounted at its rear end only on said housing at the rear end thereof for sidewise pivoting movement between an upright "use" position and a flat "storage" position, a forwardly directed stabilizing pin provided on the forward end of said handle, and a bored upright ear formed on said housing for receiving said stabilizing pin only when said handle is in its upright "use" position.

6. A travel iron as recited in claim 5 having a water reservoir and pump means in said housing, and plunger means in said handle for actuating said pump means only when said handle is in said upright "use" position to provide instant steam.

7. A travel iron comprising a housing having a sole plate, a handle pivotally mounted at its rear end on said housing at the rear end thereof for pivoting movement between an upright "use" position and a flat "storage" position alongside a portion of said housing, said handle pivotal mounting having associated therewith a cam surface and a cam pin, one each being provided on said housing and on said handle, whereby said handle is also movable longitudinally forwardly and rearwardly of said housing during pivoting movement thereof between said two positions, and stabilizing means on the forward end of said handle and on the forward portion of said housing, said stabilizing means being operational when said handle is pivoted upwardly into its upright "use" position.

8. A travel iron as recited in claim 7 having a water reservoir and pump means provided in said housing, and plunger means provided in said handle for actuating said pump means only when said handle is in said upright "use" position whereby to provide instant steam.

9. A travel iron comprising a housing having a sole plate, a water reservoir, pump means for providing instant steam, said pump means having a collapsible actuator projecting upwardly from an upper surface of said housing adjacent the forward end thereof, a handle pivotably mounted at its rear end on said housing at the rear end thereof for pivoting movement between an upright "use" position and a flat "storage" position alongside a portion of said housing, stabilizing means provided on the forward end of said handle and on the forward portion of said housing, said stabilizing means being operational only when said handle is pivoted into its upright "use" position, a bore formed in the forward end of said handle for alignment with said pump actuator, and a plunger slidably mounted in said bore and having a portion projecting above the upper surface of said handle whereby to facilitate actuation of said pump means upon downward movement of said plunger only when said handle is in its upright "use" position.

10. A travel iron as recited in claim 9 having a pair of identical, equal-value heating elements for said sole plate and a dual-voltage switch for connecting said heating elements in series in one voltage position of said switch and in parallel in the other position of said switch whereby to provide the same output wattage in either voltage position of said dual-voltage switch.

11. A travel iron comprising a housing having a sole plate, a water reservoir, pump means for providing instant steam, said pump means having a collapsible actuator projecting upwardly from an upper surface of said housing adjacent the forward end thereof, a handle pivotably mounted at its rear end on said housing at the rear end thereof for pivoting movement between an upright "use" position and a flat "storage" position alongside a portion of said housing, said handle pivotal mounting having associated therewith a cam surface and a cam pin, one each being provided on said housing and on said handle, whereby said handle is also movable longitudinally forwardly and rearwardly of said housing during pivoting movement thereof between said two positions, stabilizing means in the forward end of said handle engageable with stabilizing means on the forward portion of said housing when said handle is pivoted upwardly into its upright "use" position, a bore formed in the forward end of said handle for vertical alignment with said pump actuator, and a plunger slidably biased upwardly in said bore and having a portion normally projecting above the upper surface of said handle whereby to facilitate actuation of said pump means upon downward movement of said plunger when said handle is in said upright "use" position.

12. A travel iron comprising a housing having a sole plate, a handle pivotably mounted at its rear end on said housing at the rear end thereof for pivoting movement between an upright "use" position and a flat "storage" position alongside a portion of said housing, and said handle pivotal mounting having associated therewith a cam surface and a cam pin, one each being provided on said housing and on said handle, whereby said handle is also movable longitudinally forwardly, and rearwardly of said housing during pivoting movement thereof between said two positions.

13. A travel iron as recited in claim 12 having stabilizing means provided on the forward end of said handle and on said housing, said stabilizing means being operational only when said handle is in its upright "use" position.

14. A travel iron as recited in claim 12 having a water reservoir and pump means provided in said housing, and plunger means provided in said handle for actuating said pump means only when said handle is in said upright "use" position whereby to provide instant steam.

15. A travel iron as recited in claim 12 having a pair of identical heating elements for said sole plate and a dual-voltage switch for connecting said heating elements in series in one voltage position of said switch and in parallel in the other position of said switch.

16. A travel iron comprising a housing having a sole plate, a handle pivotably mounted at its rear end on said housing at the rear end thereof for pivoting movement between an upright "use" position and a flat "storage" position alongside a portion of said housing, said handle pivotal mounting having associated therewith a cam surface and a cam pin, one each being provided on said housing and on said handle, whereby said handle is also movable longitudinally forwardly and rearwardly of said housing during pivoting movement thereof between said two positions, a forwardly directed pin provided on said forward end of said handle, and a bored upright ear formed on said housing for receiving said handle pin when said handle is in its upright "use" position to aid in stabilizing said handle.

17. A travel iron as recited in claim 16 having a water reservoir and pump means in said housing, and plunger means in said handle for actuating said pump means only when said handle is in said upright "use" position to provide instant steam.

18. A travel iron comprising a housing having a sole plate, a water reservoir, a handle pivotably mounted at its rear end on said housing at the rear end thereof for pivoting movement between an upright "use" position and a flat "storage" position alongside a portion of said housing, said handle pivotal mounting having associated therewith a cam surface and a cam pin, one each being provided on said housing and on said handle, whereby said handle is also movable longitudinally forwardly and rearwardly of said housing during pivoting movement thereof between said two positions, a forwardly directed pin provided on the forward end of said handle, a bored upright ear formed on said housing for receiving said handle pin only when said handle is in its upright "use" position to aid in stabilizing said handle, and pump means for providing instant steam.

19. A travel iron comprising a housing having a sole plate, a water reservoir, pump means for providing instant steam, and an adjustable thermostat, said pump means having a collapsible actuator projecting upwardly from an upper surface of said housing adjacent the forward end thereof, a handle pivotably mounted at its rear end on said housing at the rear end thereof for pivoting movement between an upright "use" position and a flat "storage" position alongside a portion of said housing, said handle pivotal mounting having associated therewith a cam surface and a cam pin, one each being provided on said housing and on said handle, whereby said handle is also movable longitudinally forwardly and rearwardly of said housing during pivoting movement thereof between said two positions, stabilizing means provided on the front of said handle and on said housing, said stabilizing means being operational only when said handle is in its upright "use" position, a bore formed in the forward end of said handle for vertical alignment with said pump actuator, and a plunger slidably biased upwardly in said bore and having a portion normally projecting above the upper surface of said handle whereby to facilitate actuation of said pump means upon downward movement of said plunger when said handle is in its upright "use" position.

20. A travel iron comprising a housing having a ported sole plate, a water reservoir, pump means for providing instant steam from said ported sole plate, and an adjustable thermostat, said pump means having a collapsible actuator projecting upwardly from an upper surface of said housing adjacent the forward end thereof, a handle pivotably mounted at its rear end on said housing at the rear end thereof for pivoting movement between an upright "use" position and a flat "storage" position alongside a portion of said housing, said handle pivotal mounting having associated therewith cam means for longitudinally moving said handle forwardly and rearwardly of said housing during pivoting movement thereof between said two positions, a forwardly directed pin provided on the forward end of said handle, a bored upright ear formed on said housing for receiving said handle pin only when said handle is in its upright "use" position to aid in stabilizing said handle, a bore formed in the forward end of said handle for vertical alignment with said pump actuator, and a plunger slidably biased upwardly in said bore and having a portion normally projecting above the upper surface of said handle whereby to facilitate actuation of said pump means through said pump actuator when said handle is in its upright "use" position upon downward movement of said plunger.

21. In a travel iron as recited in claim 20, a pair of identical, equal-value heating elements for said sole plate and a dual-voltage switch for connecting said heating elements in series in one voltage position of said switch and in parallel in the other position of said switch whereby to provide the same output wattage in either voltage position of said dual-voltage switch.

22. In a pressing iron of the type having a housing with a ported sole plate, a water reservoir, and pump means for providing instant steam from said ported sole plate, the improvement which comprises said pump means having a collapsible actuator projecting upwardly from an upper surface of said housing adjacent the forward end thereof, a handle pivotably mounted at its rear end on said housing at the rear end thereof for pivoting movement between an upright "use" position and a flat "storage" position alongside a portion of said housing, said handle pivotal mounting having associated therewith a cam surface on said housing and a cam pin on said handle, whereby said handle is also movable longitudinally forwardly and rearwardly of said housing during pivoting movement thereof between said two positions, a forwardly directed stabilizing pin provided on the forward end of said handle, a bored upright ear formed on said housing for receiving said stabilizing pin when said handle is in its upright "use" position, a bore formed in the forward end of said handle for vertical alignment with said pump actuator, a plunger slidably biased upwardly in said bore and having a portion normally projecting above the upper surface of said handle whereby to facilitate actuation of said pump means upon downward movement of said plunger when said handle is in its upright "use" position, a pair of identical heating elements for said sole plate, and a dual-voltage switch for connecting said heating elements in series in one voltage position of said switch and in parallel in the other voltage position of said switch.

23. In a pressing iron as recited in claim 22 wherein said switch has a 120 volt position and a 240 volt position, wherein each of said identical heating elements has a resistance value of approximately 41 ohms, and wherein when said switch is in the 120 volt position said two heating elements are connected in series to provide an output wattage of 700 watts and when said switch is in its 240 volt position said two heating elements are connected in parallel to provide the same output wattage of 700 watts.

* * * * *